US006427778B1

(12) United States Patent
Beall et al.

(10) Patent No.: US 6,427,778 B1
(45) Date of Patent: Aug. 6, 2002

(54) CONTROL SYSTEM FOR DEEP SET SUBSURFACE VALVES

(75) Inventors: Clifford H. Beall; Brian S. Shaw, both of Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/574,150

(22) Filed: May 18, 2000

(51) Int. Cl.[7] ..... E21B 34/10
(52) U.S. Cl. ..... 166/321; 166/324
(58) Field of Search ..... 166/321, 324, 166/374, 386; 137/488, 492.5

(56) References Cited

U.S. PATENT DOCUMENTS

| | | | | |
|---|---|---|---|---|
| 3,696,868 A | * | 10/1972 | Taylor, Jr. | 166/315 |
| 4,069,871 A | | 1/1978 | Page, Jr. | |
| 4,161,219 A | | 7/1979 | Pringle | |
| 4,252,197 A | | 2/1981 | Pringle | |
| 4,341,266 A | | 7/1982 | Craig | |
| 4,361,188 A | | 11/1982 | Russell | |
| 4,373,587 A | | 2/1983 | Pringle | |
| 4,431,051 A | | 2/1984 | Adams, Jr. | |
| 4,448,254 A | | 5/1984 | Barrington | |
| 4,660,646 A | | 4/1987 | Blizzard | |
| 4,676,307 A | | 6/1987 | Pringle | |
| 4,951,753 A | * | 8/1990 | Eriksen | 166/375 |
| 5,127,477 A | | 7/1992 | Schultz | |
| 5,310,004 A | | 5/1994 | Leismer | |
| 5,415,237 A | | 5/1995 | Strattan | |
| 5,564,501 A | | 10/1996 | Strattan | |
| 5,906,220 A | | 5/1999 | Thompson | |
| 5,971,353 A | | 10/1999 | Johnson | |
| 6,109,351 A | * | 8/2000 | Beall | 166/321 |
| 6,173,785 B1 | * | 1/2001 | Adams et al. | 166/375 |

FOREIGN PATENT DOCUMENTS

| | | |
|---|---|---|
| EP | 0038034 A2 | 10/1981 |
| GB | 2047304 | 4/1979 |
| GB | 2159193 | 5/1984 |
| GB | 2183695 | 11/1985 |
| GB | 2309241 | 7/1997 |

* cited by examiner

*Primary Examiner*—William Neuder
(74) *Attorney, Agent, or Firm*—Steve Rosenblatt

(57) ABSTRACT

The hydraulic control system for operating a flow tube in a subsurface safety valve is disclosed. An isolation piston is used in conjunction with an operating control line and an engagement control line. Both control lines run from the surface. The isolation piston is spring loaded to equalize pressure across a dynamic piston to allow the flow tube to be shifted by a power spring to allow in turn the subsurface safety valve to close. Application of pressure on the engagement control line directs pressure applied through the operating control line to the top of the dynamic piston thus shifting the flow tube downwardly to open the subsurface safety valve. In an alternative embodiment, a coaxial control line directs fluid to the top of the dynamic piston and additionally to a parallel path leading to the bottom of the dynamic piston where a control valve is mounted. The control valve can be actuated hydraulically, electronically or other ways such that when it is closed the pressure applied to the dynamic piston shifts the flow to open the subsurface safety valve. A loss of signal to the control valve equalizes the dynamic piston allowing the flow tube to shift.

20 Claims, 2 Drawing Sheets

CONTROL SYSTEM FOR DEEP SET SUBSURFACE VALVES

FIELD OF THE INVENTION

The field that this invention relates to control systems for downhole valves and more particularly subsurface safety valves.

BACKGROUND OF THE INVENTION

Subsurface safety valves principally are designed around the concept of a spring actuated flow tube which is hydraulically operated so that when the flow tube is shifted downwardly it displaces a flapper off of a seat by rotating it ninety degrees leaving the central passage in the flow tube open. Reversal of these movements allows the spring loaded flapper to rotate ninety degrees against the seat and seal off the flow path. Control systems to actuate the flow tube into a downward motion to open the subsurface safety valve have come in a variety of configurations in the past. One of the design parameters is obviously the ability to shift the flow tube to open the subsurface safety valve. Another design parameter is to allow the hydraulic control system to have a fail safe operation in the event there are malfunctions in the system. Yet another criteria is to make such a system small and uncomplicated to ensure its reliability over an extended period of time in which the subsurface safety valve may be in operation in a well.

One of the problems of control system designs particularly in applications where the subsurface safety valve is set deeply such as depths below ten thousand feet from the surface is that the power spring on the flow tube may be required to support the hydrostatic pressure in the control lines to the dynamic piston which moves the flow tube. Since the required stroke of the flow tube is quite long, springs that can resist hydrostatic at such depths become very cumbersome. Accordingly one of the objects of the present invention is to provide a system for hydraulic flow tube control where the power spring requirements are such that it is not mandatory to be able to support the control line hydrostatic pressure in the control system. Another objective of the present invention is to eliminate charged chambers usually filled with nitrogen that have been employed in some of the designs used in the past. Another objective of the present invention is to offer a simplified system which can be easily modified for a variety of depths and can provide reliable service over a long period of time while at the same time being simple to construct and simple in its operation.

Control systems typical of those previously used can be readily understood from a review of U.S. Pat. Nos. 5310004, 5906220, 5415237, 4341266, 4361188, 5127477, 4676307, 466646, 4161219, 4252197, 4373587, 4448254, 5564501 as well as U.K. Applications 2159193, 2183695, 2047304.

SUMMARY OF THE INVENTION

The hydraulic control system for operating a flow tube in a subsurface safety valve is disclosed. An isolation piston is used in conjunction with an operating control line and an engagement control line. Both control lines run from the surface. The isolation piston is spring loaded to equalize pressure across a dynamic piston to allow the flow tube to be shifted by a power spring to allow in turn the subsurface safety valve to close. Application of pressure on the engagement control line directs pressure applied through the operating control line to the top of the dynamic piston thus shifting the flow tube downwardly to open the subsurface safety valve. In an alternative embodiment, a coaxial control line directs fluid to the top of the dynamic piston and additionally to a parallel path leading to the bottom of the dynamic piston where a control valve is mounted. The control valve can be actuated hydraulically, electronically or other ways such that when it is closed the pressure applied to the dynamic piston shifts the flow to open the subsurface safety valve. A loss of signal to the control valve equalizes the dynamic piston allowing the flow tube to shift.

DETAILED DESCRIPTION OF THE DRAWINGS

DETAILED DESCRIPTION OF THE PREFERRED EMBODIMENT

Figure 1:
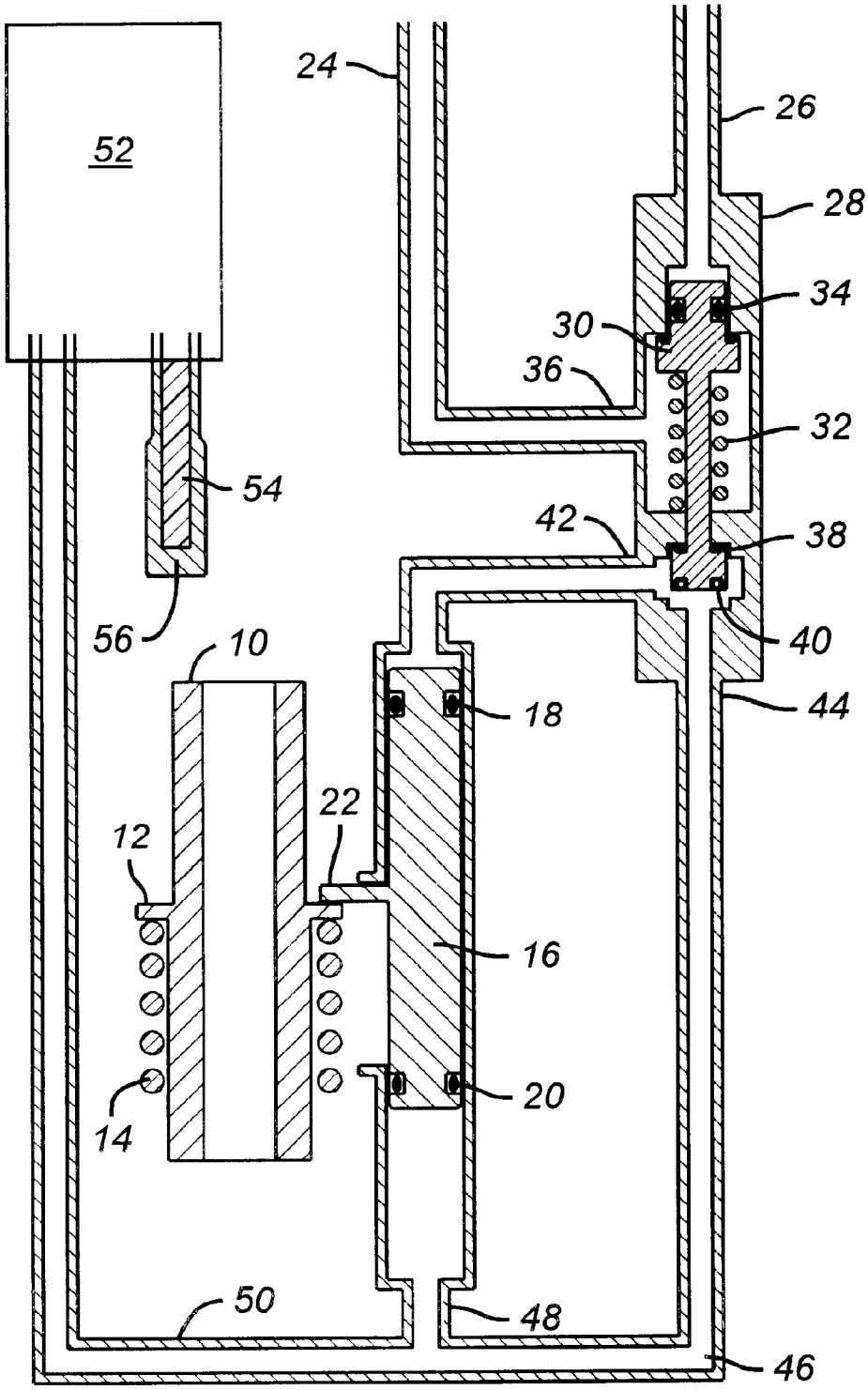
FIG. 1 is a schematic view of the preferred embodiment of the present invention showing the subsurface safety valve in the closed position.

FIG. 1 illustrates a flow tube 10 having a circular flange 12 on its outer periphery on which the power spring 14 delivers an upward force. The subsurface safety valve is presumed to be known by those skilled in the art. It is not depicted in FIG. 1. Those skilled in the art already know that the movement of the flow tube 10 in a downward position which compresses the power spring 14 opens the subsurface safety valve. The reverse movement closes the subsurface safety valve.

The flow tube 10 is actuated downwardly by a dynamic piston 16 which has an upper seal 18 and a lower seal 20. The dynamic piston 16 has a tab 22 which bears on flange 12 such that when the dynamic piston 16 is powered down, it compresses power spring 14 while moving flow tube 10 downwardly.

Running from the source of hydraulic fluid pressure at the surface are operating control line 24 and engagement control line 26. Both lines 24 and 26 run into a housing 28 in which there is disposed an isolation piston 30 which is spring loaded by spring 32. A seal 34 seals off the engagement control line 26 so that pressure applied in line 26 will shift the isolation piston 30 downwardly compressing spring 32. The operating control line 24 enters housing 28 at inlet 36. The isolation piston 30 has an upper face seal 38 and a lower face seal 40. In the position shown in FIG. 1 the bias of spring 32 seats the upper face seal 38 against the housing 28. The size of the seal areas for upper face seal 38 and seal 34 are nearly the same putting the isolation piston 30 in pressure balance from applied pressures at port 36 from operating control line 24 in the position shown in FIG. 1. Housing 28 also has outlets 42 and 44. Outlet 42 is in fluid communication with dynamic piston 16 above seal 18 while outlet 44 is in fluid communication with dynamic piston 16 below seal 20. There is a conduit 46 which branches into conduits 48 and 50. Conduit 48 leads to dynamic piston 16 below seal 20. Conduit 50 extends conduit 46 toward a coil 52. Coil 52 has a filter 54 and is otherwise open at an outlet 56 to the surrounding annulus (not shown). Filter 54 keeps particulate matter out of coil 52 and conduit 50.

The significant components of the preferred embodiment now having been described, its operation will be reviewed in greater detail. In order to shift the flow tube 10 downwardly against the bias of power spring 14 pressure is first applied in engagement control line 26 which downwardly shifts the isolation piston 30 against the bias of spring 32. This downward movement of isolation piston 30 brings the upper face seal 38 away from body 28 thus opening up a flow path from inlet 36 to outlet 42. The downward movement of isolation piston 30 ceases when the lower face seal 40 contacts the housing 28 effectively shutting off outlet 44. Thereafter, applied pressure in operating control line 24 communicates through outlet 42 to dynamic piston 16 above seal 18 pushing downwardly and along with it tab 22. Tab 22 in turn bears on flange 12 which in turn pushes down flow tube 10 against the power spring 14. The subsurface safety valve is now open. The downward movement of the dynamic piston 16 with the lower face seal 40 against housing 28 will also result in displacement of fluid in conduit 50 through coil 52 and out the filter 54 through outlet 56 to the annulus (not shown).

In order to close the subsurface safety valve, the pressure on the engagement control line 26 is removed. The spring 32 which is sufficiently strong to resist the hydrostatic pressure in engagement control line 26 lifts the isolation piston 30 upwardly so as to move the lower face seal 40 away from housing 28 which in turn allows outlet 42 and 44 to communicate through housing 28 which has the effect of equalizing pressure on the dynamic piston 16 above and below seals 18 and 20 respectively. When this occurs, the power spring 14 can then move the flow tube 10 upwardly to allow the subsurface safety valve to close.

Clearly, if pressure is lost due to leakage or other surface system failures in the engagement control line 26 the flow tube 10 will shift upwardly as pressure is equalized across the dynamic piston 16 due to spring 32 shifting the isolation piston 30 upwardly. A leakage around the lower face seal 40 will equalize pressure on the dynamic piston 16 which will allow the flow tube 10 to move upwardly. As previously stated, a leakage past seal 34 will prevent movement of isolation piston 30 against spring 32 and should result in a closure of the subsurface safety valve by movement upwardly of the flow tube 10.

A leakage around seal 18 when the flow tube 10 is in the down position will most likely leak hydraulic fluid from outlet 42 into the tubular string which the subsurface safety valve was mounted. A leakage around seal 20 may allow the annulus to leak into the tubular through outlet 56 if the annulus pressure exceeds the tubular pressure. If it is the other way, and tubular pressure will leak past seal 20 and into the annulus through filter 54. In the event of leakage around seal 18, the hydraulic fluid in the system coming from operating control line 24 will leak into the tubular as previously stated. However, as long as pressure is maintained in the engagement control line 26, the flow tube 10 may not rise under the force of spring 14 if spring 14 is too weak to overcome the hydrostatic pressure in operating control line 24. Spring 14 does not need to be sized to counteract the expected hydrostatic pressure for the given depth in operating control line 24 in that upon equalization around the dynamic piston 16 the power spring 14 merely needs to overcome frictional forces and the weight of the flow tube 10 to be able to raise it up. In deep settings of the subsurface safety valve and in view of the long stroke required for the flow tube 10 having a power spring 14 sufficiently strong to able to withstand the hydrostatic in a control line such as operating control line 24 would be difficult to configure in a compact design. On the other hand, the stroke of the isolation piston 40 is very short and therefore, it is far easier to equip a spring 32 suitable for resisting hydrostatic in engagement control line 26 and keep the size of the spring 32 reasonable.

The design described in FIG. 1 has the advantage of not needing a pressurized chamber, but in turn it has the disadvantage of displacement of hydraulic fluid into the annulus when the dynamic piston 16 is stroked downwardly to open the subsurface safety valve. Additionally, if certain types of leaks develop, the arrangement in FIG. 1 will not necessarily fail safe unless pressure is removed from the engagement control line 26. For example, leakage past seal 18 from outlet 42 will keep the flow tube in the down position until the leak becomes catastrophic in size or until the pressure is removed from engagement control line 26.

Those skilled in art will appreciate that the size in the power spring 14 in the design of FIG. 1 is independent of depth. On the other hand, the spring 32 must be substantially stiff to be able to withstand the hydrostatic in the engagement control line 26.

The spring 32 is far smaller and can be easily changed to reconfigure a particular control system to a depth to which it will be installed.

Figure 2:
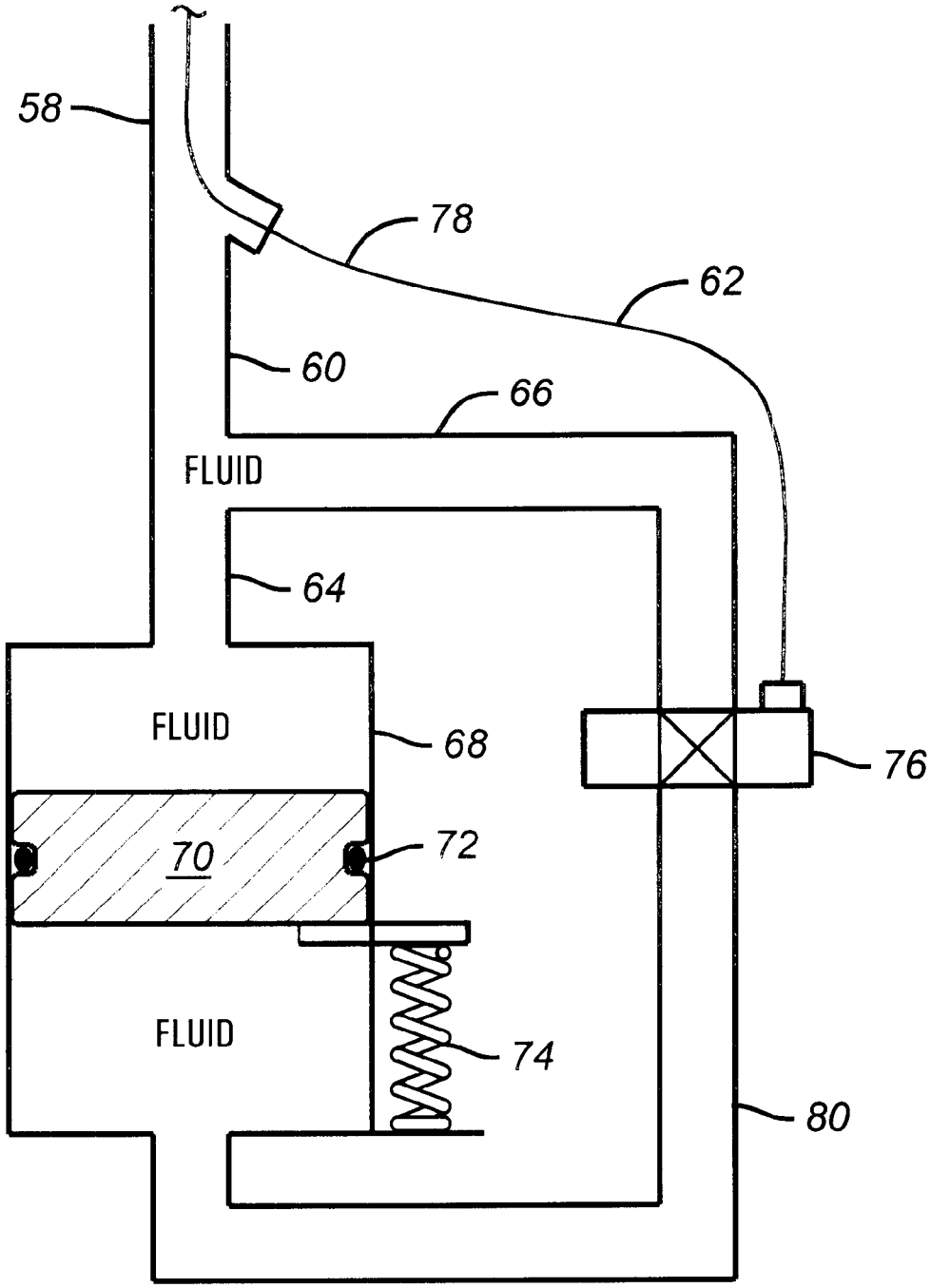
FIG. 2 is a schematic view of an alternative embodiment of the present invention showing the subsurface safety valve in the open position.

FIG. 2 represents an alternative embodiment which schematically illustrates a coaxial control line 58 which can simultaneously convey fluid pressure into conduit 60 and carry a conductor which is optical electromagnetic or even hydraulic or electrical 62. Conduit 60 branches into conduits 64 and 66. Conduit 64 leads to cylinder 68 in which is a piston 70 with a peripheral seal 72. Piston 70 is biased by a power spring 74. Upward movement of piston 70 moves a flow tube (not shown) which in turn allows the subsurface safety valve to close. Downward movement of piston 70 compresses spring 74 and pushes the flow tube down which opens the subsurface safety valve in a known matter. Conduit 66 extends to a control valve 76 which basically functions in two positions, open and closed. The signal to open or close comes from the conduit 78 through a conductor 62, if used, to the control valve 76. Conduit 80 extends from control valve 76 to the cylinder 68 below piston 70. Those skilled in art can readily appreciate that when the control valve 76 is closed and hydraulic pressure is brought to bear in conduit 64, the piston 70 is driven down compressing the spring 74, thus, opening the subsurface safety valve. In order to close the subsurface safety valve, the control valve 76 is opened from a signal through conduit 78 which as previously stated can be any one of a variety of different signals. With the control valve 76 in the open position the pressure equalizes between conduit 66 and 80 thus allowing the spring 74 to move the piston 70 upwardly to allow the subsurface safety valve to close. The alternative embodiment shown in FIG. 2 is again another simplified process which uses known coaxial technology to allow a conduit for communication of a hydraulic signal to be run coaxially or contemporaneously with a signal line which can be optical, electromagnetic, electrical, hydraulic or some other type of signal for operating a bypass valve between an opened and closed position. Those skilled in art will appreciate that if the signal is lost to the valve 76 it reverts to an open position which will close the subsurface safety valve. Additionally, loss of pressure in conduit 58 will also close the valve in the normal operation.

Those skilled in art will appreciate that there are alternatives even in the preferred embodiment shown in FIG. 1 to the isolation piston arrangement. While the isolation piston 30 has been shown to be hydraulically actuated, it can be actuated in a variety of different ways. The assembly of the housing 28 and isolation piston 30 can also be replaced by equivalent structures which allow for the normal operation of the flow tube 10. Thus, other types of valving arrangements which selectively allow pressurization of the dynamic piston 16 and equalization around the dynamic piston 16 for normal and emergency operations are also within the preview of the invention.

The preceding description of the preferred and alternative embodiment is illustrative of the invention and is by no means a limitation of what can be claimed to be the invention which can only be seen from an examination of the claims which appear below.

What is claimed is:

1. A control system extending from a well surface for a subsurface valve actuated by a dynamic piston, comprising:

a dynamic piston mounted in a housing having an upper and lower seal and operably connected to the subsurface valve for movement of the subsurface safety valve between an open and a closed position;

an equalizing valve mounted in a second housing and movable in opposed directions;

at least one control line extending exclusively from the surface to said second housing for operation of said equalizing valve in said second housing in at least one direction to move said dynamic piston in at least one direction for desired movement of said subsurface safety valve between said open and said closed positions.

2. The system of claim 1 wherein:

said control line comprises a plurality of passages.

3. The system of claim 2, wherein:

said passages are coaxial.

4. The system of claim 3, wherein:

one of said passages is used to operate said equalizing valve and another passage is used to supply pressure to said dynamic piston above said upper seal in said housing.

5. The system of claim 1, wherein:

said equalizing valve is operated optically, electromagnetically, electronically or hydraulically.

6. The system of claim 1, wherein:

opening of said equalizing valve allows for equal pressure to exist in said housing above said upper seal and below said lower seal;

said dynamic piston further comprises a return spring which is incapable of overcoming hydrostatic pressure in said housing above said upper seal.

7. A control system for a subsurface valve, comprising:

a dynamic piston in a first housing having an upper and lower seal and a return spring acting thereon;

an isolation piston in a second housing, said second housing having at least two inlets;

said inlets to said second housing connected to a first and second control line, respectively;

said isolation piston further comprising a closure spring which is capable of overcoming hydrostatic pressure in at least one of said control lines;

whereupon movement of said isolation piston by said closure spring pressure in said housing above said upper seal is equalized with pressure below said lower seal to allow said return spring to shift said dynamic piston.

8. The system of claim 7, further comprising:

a first and second outlets from said second housing, said outlets in fluid communication with said first housing above and below said upper and lower seals, respectively;

said isolation piston further comprises opposed seals for selectively equalizing said first and second outlets and selectively isolating them from each other.

9. The system of claim 8, further comprising:

a vent outlet to said second outlet such that hydraulic fluid is displaced past said vent outlet when said dynamic piston experiences a greater pressure above said upper seal than below said lower seal.

10. The system of claim 8, further comprising:

an inlet seal on said isolation piston to allow pressure buildup in said second inlet to shift said isolation piston against the force of said closure spring.

11. The system of claim 10, wherein:

said first inlet is disposed in said second housing between said inlet seal and said opposed seals on said isolation piston;

said isolation piston in substantial pressure balance from applied pressure from said first inlet.

12. The system of claim 11, wherein:

said opposed seals comprise an upper and lower face seals, said upper face seal engaged by a force applied by said closure spring, whereupon said lower face seal is disabled to equalize said first and second outlets.

13. The system of claim 12, wherein:

said lower face seal is energized in said second housing by pressure in said second inlet which overcomes said closure spring, whereupon said first inlet is aligned to said first outlet and isolated from said second outlet.

14. The system of claim 7, wherein:

said return spring is weaker than hydrostatic pressure in said first housing above said upper seal.

15. The system of claim 9, further comprising:

a coil and filter connected to said vent outlet.

16. The system of claim 7, further comprising:

two control lines connected respectively to said first and second inlets of said second housing.

17. The system of claim 7, further comprising:

one control line having discrete passages for connection to said first and second inlets of said second housing.

18. The system of claim 17, wherein:

said passages are coaxial.

19. A control system for a subsurface safety valve comprising:

a dynamic piston in a first housing with a return spring acting thereon, said dynamic piston comprising an upper and a lower seal and said return spring being weaker than hydrostatic pressure on said dynamic piston acting above said upper seal;

an isolation piston in a second housing having two control lines connected thereto said isolation piston acted on by a closure spring which overcomes hydrostatic pressure in one of said control lines;

said second housing in fluid communication with said first housing;

said isolation piston movable from a first position where the pressure in said first housing above said upper seal is equalized with the pressure below said lower seal, and a second position where applied pressure in one of said control lines can put an unbalanced force on said dynamic piston in said first housing and above said upper seal.

20. The system of claim 19, wherein:

pressure must be applied in both control lines to first overcome said closure spring and second to direct pressure to said first housing above said upper seal as a result of shifting of said isolation piston.

* * * * *